US005431504A

United States Patent [19]

Beadman et al.

[11] Patent Number: 5,431,504

[45] Date of Patent: Jul. 11, 1995

[54] PRINTING APPARATUS WITH CASSETTE

[75] Inventors: Michael A. Beadman; Charles R. Sims, both of Royston, United Kingdom

[73] Assignee: Esselte Dymo N.V., St. Niklaas, Belgium

[21] Appl. No.: 180,241

[22] Filed: Jan. 11, 1994

[30] Foreign Application Priority Data

Jan. 14, 1993 [GB] United Kingdom ..... 9300716

[51] Int. Cl.[6] ..... B41J 29/02

[52] U.S. Cl. ..... 400/692; 400/234; 400/54

[58] Field of Search ..... 400/54, 207, 208, 223, 400/234, 74, 692, 207 E

[56] References Cited

U.S. PATENT DOCUMENTS

| | | | |
|---|---|---|---|
| 4,147,439 | 4/1979 | Colecchi | 400/234 |
| 4,480,936 | 11/1984 | Kasun et al. | 400/207 |
| 4,868,676 | 9/1989 | Matsuura et al. | 400/613 |
| 5,168,286 | 12/1992 | Okauchi et al. | 400/234 |
| 5,193,919 | 3/1993 | Godo et al. | 400/120 |
| 5,295,753 | 3/1994 | Godo et al. | 400/612 |
| 5,302,034 | 4/1994 | Kitazawa | 400/207 |
| 5,308,173 | 5/1994 | Amano et al. | 400/120 |

FOREIGN PATENT DOCUMENTS

| | | |
|---|---|---|
| 0413358A2 | 2/1991 | European Pat. Off. . |
| 0450402A2 | 9/1991 | European Pat. Off. . |
| 487313A | 5/1992 | European Pat. Off. . |
| 61-163883 | 7/1986 | Japan . |
| 3151261 | 6/1991 | Japan . |
| 5155067 | 6/1993 | Japan . |
| 2234469 | 2/1991 | United Kingdom . |

*Primary Examiner*—Ren Yan
*Attorney, Agent, or Firm*—Pennie & Edmonds

[57] ABSTRACT

A printing apparatus is described which enables a cassette to be removed more easily. This is done by tightening the tape within the cassette automatically in response to movement of a printing mechanism from its operative to its inoperative position.

10 Claims, 5 Drawing Sheets

PRINTING APPARATUS WITH CASSETTE

FIELD OF THE INVENTION

The present invention relates to a printing apparatus which operates with a cassette. The invention is particularly but not exclusively concerned with thermal printing devices which operate with a supply of tape arranged to receive an image and a means for transferring an image onto the tape.

BACKGROUND TO THE INVENTION

In known such devices, a tape holding case holds a supply of image receiving tape and a supply of an image transfer ribbon the image receiving tape and the transfer ribbon being passed in overlap through a printing zone of the printing device. In our earlier copending U.S. application Ser. No. 08/069,256, there is described a different type of thermal printing device which receives two separate tape holding cases, one holding a supply of image receiving tape and the other holding a supply of an image transfer ribbon. The image receiving tape and the transfer ribbon must again be located in overlap through a printing zone of the printing device. The tape holding case or cassette which holds the supply of image receiving tape has a recess for accommodating a platen of the printer, the image receiving tape being guided across that recess by guide features of the cassette. The tape holding case or cassette holding a supply of image transfer ribbon has a recess for accommodating a printhead of the printing device, the image transfer ribbon being guided across that recess by guide features of the cassette. The platen and printhead cooperate to define a print zone. In normal operation of the printing device, the image receiving tape cassette is located in a cassette receiving bay of the printing device with the image receiving tape guided across the platen receiving recess. The image transfer ribbon cassette is likewise received in the cassette receiving bay of the printing device with the image transfer ribbon guided across the printhead receiving recess in overlap with the image receiving tape. The cassettes can be separately and independently removed and replaced in the printing device.

The printhead is movable between an operative position in which it holds the image transfer ribbon and image receiving tape against the platen for printing and an inoperative position in which it is spaced from the platen to enable the cassettes to be released. A difficulty can arise in that, when the printhead is returned from its operative position to its inoperative position, the image transfer ribbon may retain its original shape since it has insufficient resilience to be drawn back with the printhead. If this happens, there will be a loop of image transfer ribbon which will make it difficult for the image receiving tape cassette to be inserted into the printing device. The present invention seeks to overcome this problem.

SUMMARY OF THE INVENTION

According to the present invention there is provided a printing apparatus including a cassette receiving portion for receiving a cassette containing a supply of tape, a drive member for driving a take-up spool of a cassette received in the cassette receiving portion and a printing mechanism comprising first and second cooperating printing elements arranged so that tape extends between the printing elements when a cassette is located in the cassette receiving portion, at least the first of which is movable between an operative and an inoperative position, the printing apparatus further comprising means responsive to movement of the first printing element from its operative to its inoperative position to cause the drive member to rotate, thereby rotating the take-up spool of a cassette inserted in the printing apparatus.

This solves the problem outlined above, since if tape in the cassette retains a loop or kink when the first printing element is moved from its operative to its inoperative position, the resulting automatic drive of the drive member for the take-up spool causes the tape to become taut. The drive member is rotated for only a short time, sufficient to render the tape taut.

Where the cassette receiving portion of the printing apparatus is intended to receive a further cassette, with tape guided in overlap with tape of the first cassette between the first and second printing elements, insertion and removal of the second cassette are thereby facilitated.

In the described embodiment, the first and second cooperating printing elements are a printhead and platen. The platen is preferably located in a fixed location, but is rotatable. The printhead is preferably movable between the operative and inoperative positions. The first cassette preferably includes image transfer ribbon or ink ribbon which is guided past the printhead, the cassette having a recess for accommodating the printhead. The second cassette preferably contains image receiving tape which is guided past the platen across a platen receiving recess of the second cassette.

The drive means which is used to rotate the drive member can also be used to rotate the platen in operation of the printer to drive image receiving tape through the print zone while printing is carried out.

For a better understanding of the present invention and to show how the same may be carried into effect reference will now be made by way of example to the accompanying drawings.

DESCRIPTION OF THE PREFERRED EMBODIMENT

Figure 1:
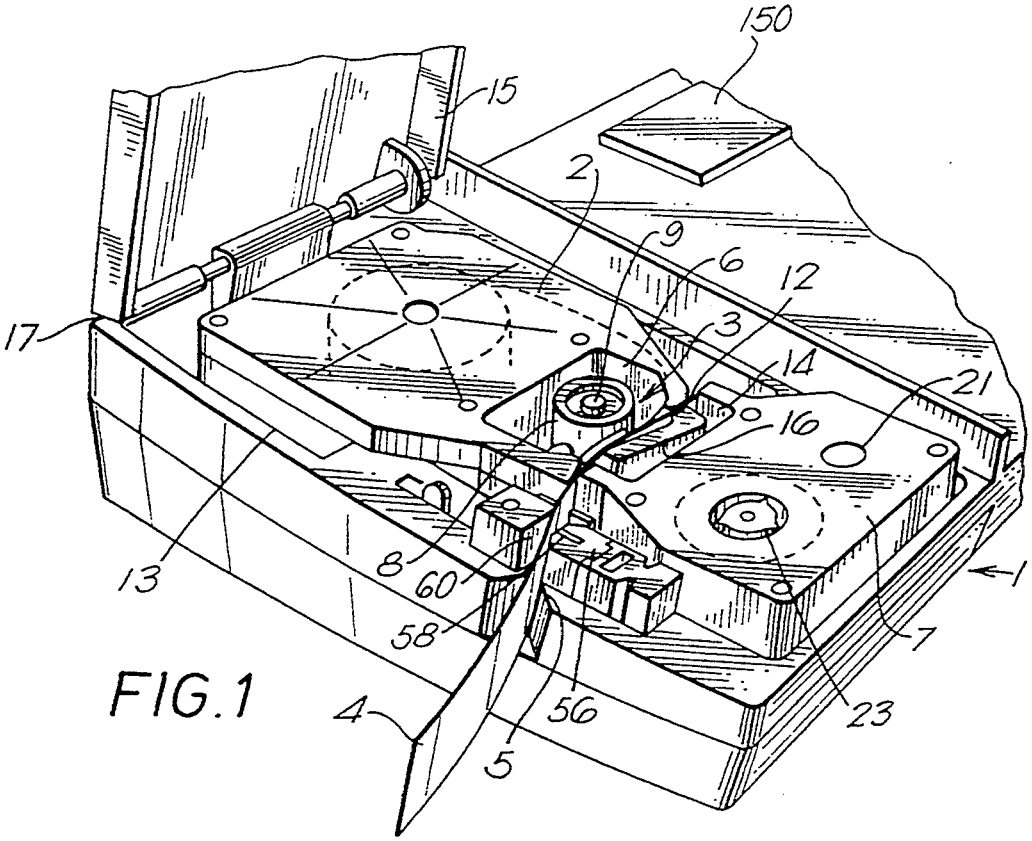
FIG. 1 illustrates a printing apparatus with first and second cassettes located therein.

FIG. 1 shows part of a printing device having a main body 1 which carries a keyboard and display for using the printing device. The keyboard and display are not shown in FIG. 1, although part of the display is visible and is indicated by reference numeral 150. The operation of the printing device is not described herein as it does not form part of the present invention. In brief, the printing device can be used to formulate and print labels in accordance with the user's requirements. By way of example reference is made to our copending U.S. application Ser. No. 08/069,256, the contents of which are herein incorporated by reference, which describes some aspects of operation of the printer.

The main body 1 of the printing device has a cassette receiving bay 13. A lid 15 is hinged to the rear 17 of the cassette receiving bay 13 and is movable between a closed position in which it covers the cassette receiving bay 13 and an open position shown in FIG. 1. The cassette receiving bay 13 receives two cassettes. The rearmost cassette 2 contains a supply of image receiving tape 4 which passes through a print zone 3 of the printer to an outlet 5 of the printer. The image receiving tape 4 comprises an upper layer for receiving a printed image on one of its surfaces and having its other surface coated with an adhesive layer to which is secured a releaseable backing layer. The cassette 2 has a recess 6 for accommodating a platen 8 of the printer. The platen 8 is mounted for rotation on a pin 9.

The frontmost cassette 7 contains a thermal transfer ribbon 12 which extends from a supply spool 21 to a take-up spool 23 within the cassette 7. The thermal transfer ribbon 12 extends through the print zone 3 in overlap with the image receiving tape 4. The cassette 7 has a recess 14 for receiving a printhead 16 of the printer. The printhead 16 is movable between an operative position in which it bears against the platen 8 and holds the thermal transfer ribbon 12 and image receiving tape 4 in overlap between the printhead and the platen, and an inoperative position, shown in FIG. 1, in which it is moved away from the platen 8 to receive the thermal transfer ribbon 12 and image receiving tape 4. In the operative position, the platen 8 is rotated to cause image receiving tape to be driven past the printhead and the printhead is controlled to print an image onto the image receiving tape by thermal transfer of ink from the ribbon 12. The printhead is a conventional thermal printhead having an array of pixels each of which can be thermally activated in accordance with the desired image to be printed.

FIG. 1 also illustrates a cutting assembly for the printer, comprising a spring-loaded blade holder designated generally by reference numeral 56 holding a blade 58 which can be forced against an anvil 60. The blade 58 is not designed to cut entirely through the tape 4 but is designed to cut only through the image receiving layer of the image receiving tape and not through the releaseable backing layer to form a so-called tab cut. Although it is not clear from FIG. 1, there is in addition cooperating scissor blades which cooperate one with another to perform a scissor cut to cut off a portion of the printed tape while a tab cut is made. This is described for example in our above referenced copending U.S. application Ser. No. 08/069,256.

Figure 2:
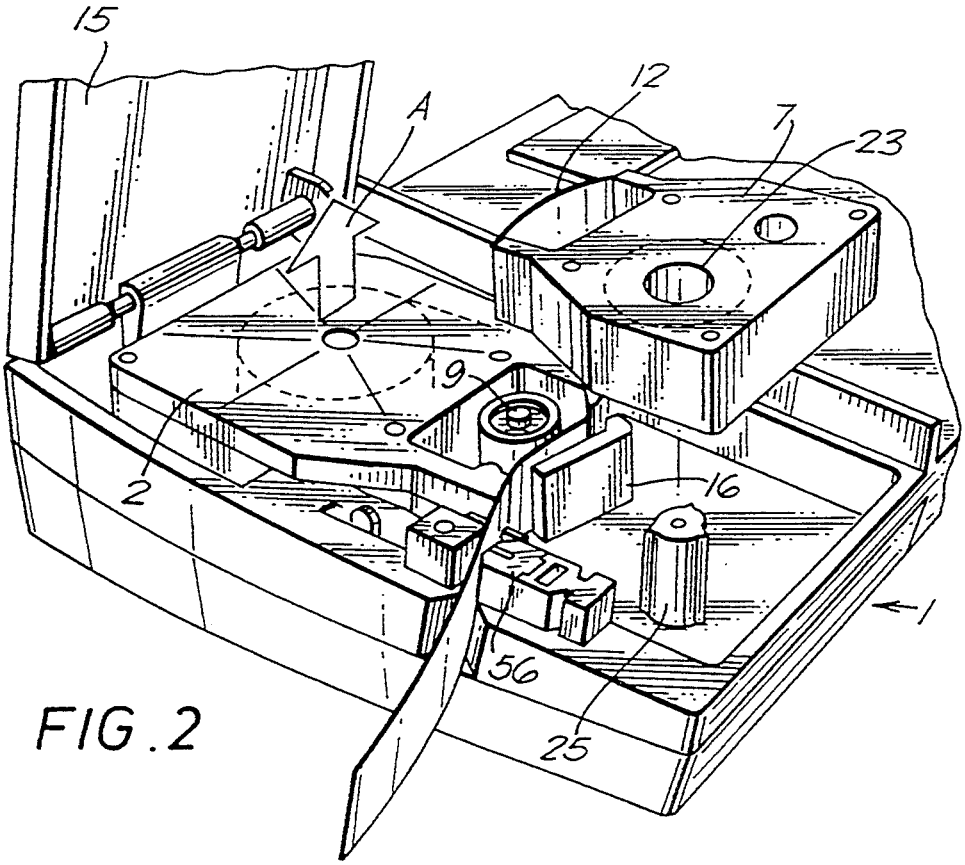
FIG. 2 illustrates removal of the first cassette.

When the lid of the printing device is opened, the printhead 16 is moved automatically through a mechanical linkage from its operative position bearing against the platen 8 to its inoperative position spaced from the platen 8. This can be accomplished in the manner described in EP-A-0487313. With the lid open, the cassettes can thus be individually removed and replaced. FIG. 2 illustrates how the ink ribbon cassette 7 can be removed from the printing device by lifting it upwards. The image receiving tape cassette 2 can be removed separately in the same way as indicated by the arrow A. FIG. 2 illustrates clearly a drive member 25 for the take-up spool 23 of the ink ribbon cassette 7.

Figure 3:
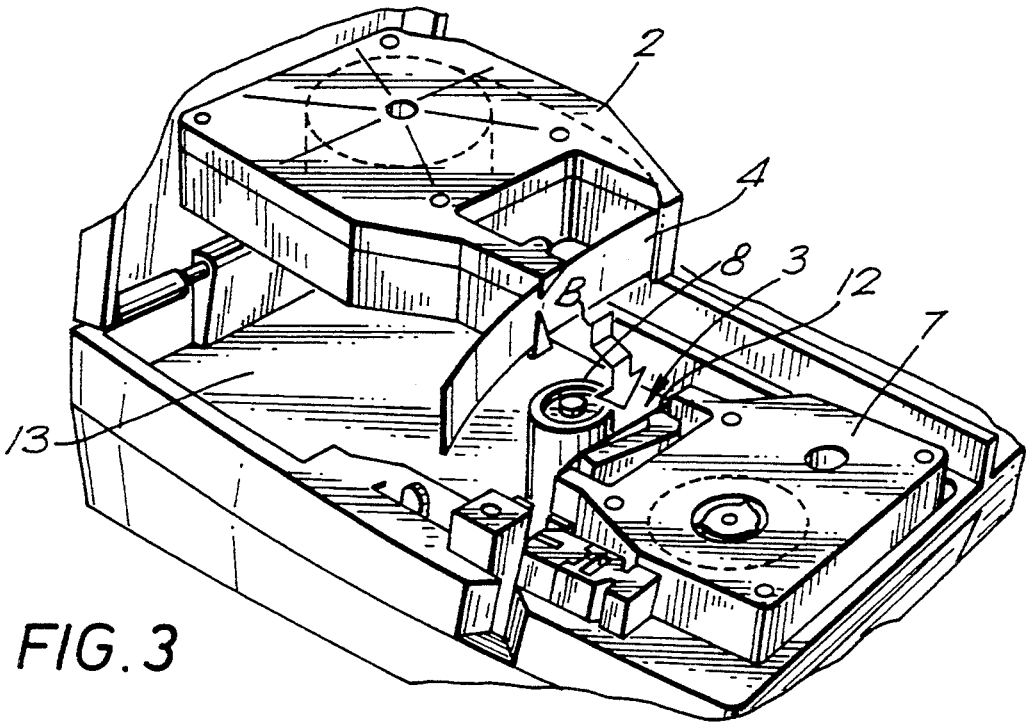
FIG. 3 illustrates replacement of the second cassette.

Due to the lack of resilience of the ink ribbon 12 in the ink ribbon cassette 7, a problem can arise in insertion of the image receiving tape cassette 2. FIG. 3 illustrates how the image receiving tape cassette 2 is to be inserted into the printing device cassette receiving bay 13, see arrow B. That is, it should be lowered ensuring that the stretch of image receiving tape 4 guided across the print zone 3 is located between the platen 8 and ink ribbon 12 of the ink ribbon cassette which is already in place. This is not a problem as long as the stretch of ink ribbon guided across the print zone 3 is substantially taut as shown in FIG. 3.

Figure 4:
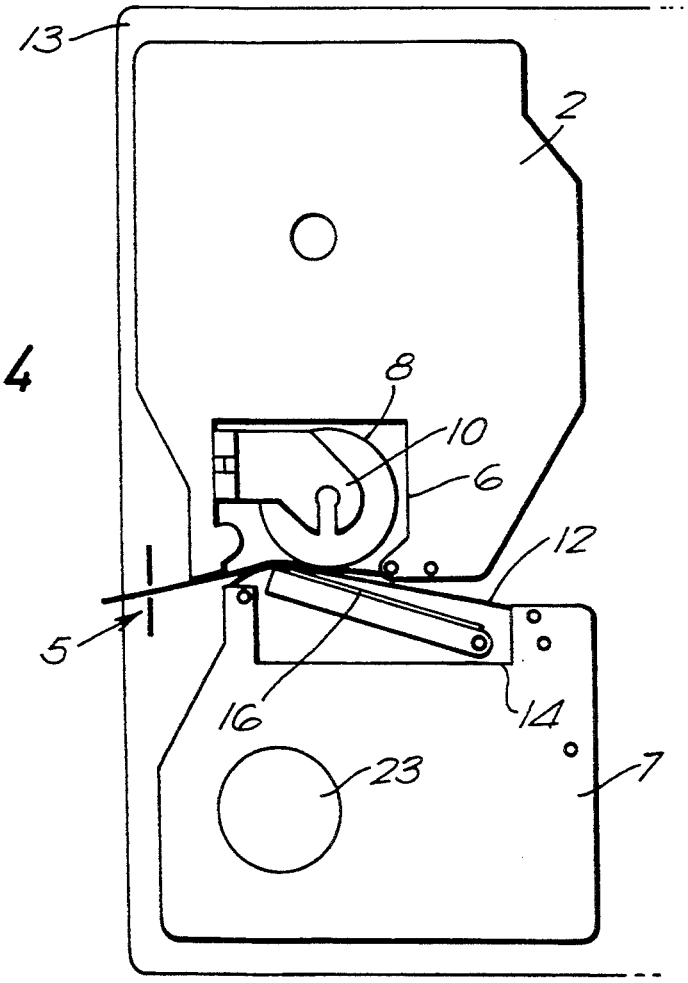
FIGS. 4 to 6 are diagrammatic plan views illustrating the problem and solution of the present invention.
Figure 5:
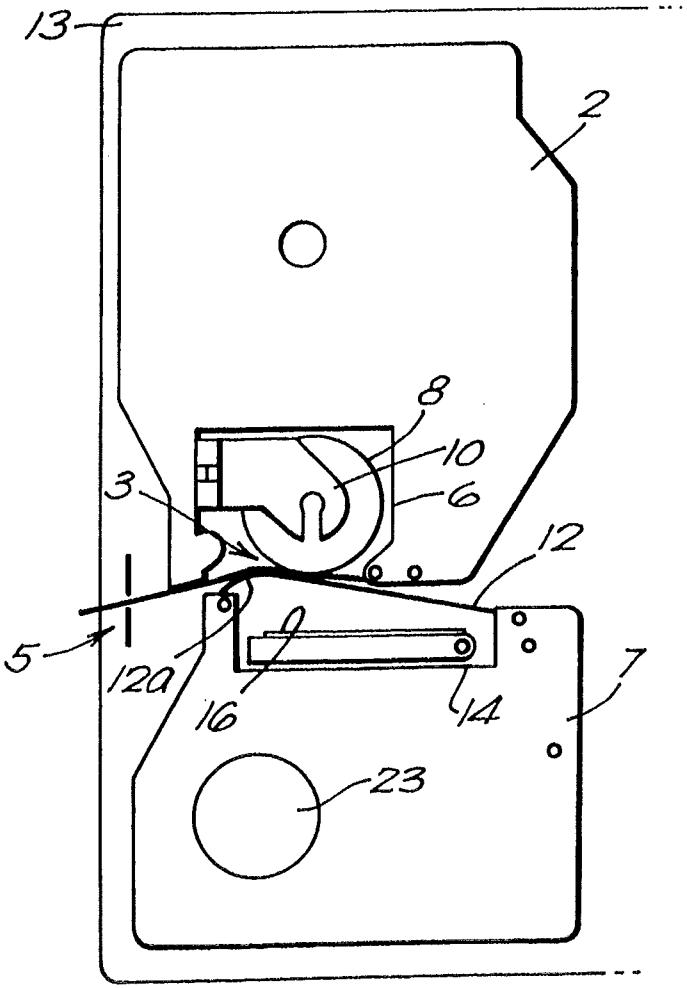

FIGS. 4 and 5 illustrate what can happen in practice. FIG. 4 is a diagrammatic view showing in plan the two cassettes inserted in the cassette receiving bay 13. The printhead 16 is shown in its operative position, that is the position it will adopt with the lid 15 closed. In this position, the ink ribbon 12 is pressed against the platen 8 so that printing can be accomplished. When the lid 15 of the printing device is opened, the printhead 16 returns to its inoperative position as shown in FIG. 5. However, the ink ribbon 12 may retain its original shape since it has insufficient resilience to be drawn back with the printhead 16. If this happens, there will be a loop of ink ribbon 12 which will make it difficult for the image receiving tape cassette 2 to be inserted into the printing device. This loop is denoted by reference numeral **12*a* in FIG. 5**.

The present invention seeks to overcome this problem by causing the drive member 25 for the take-up spool 23 to be rotated automatically after the lid of the printing device has been opened. The small rotation of the take-up spool 23 which is thereby accomplished causes the ink ribbon 12 to be pulled taut where it is guided across the print zone 5 as in FIG. 6. Once this has been done, the image receiving tape cassette 2 can be inserted without difficulty in the manner illustrated in FIG. 3.

Figure 7:
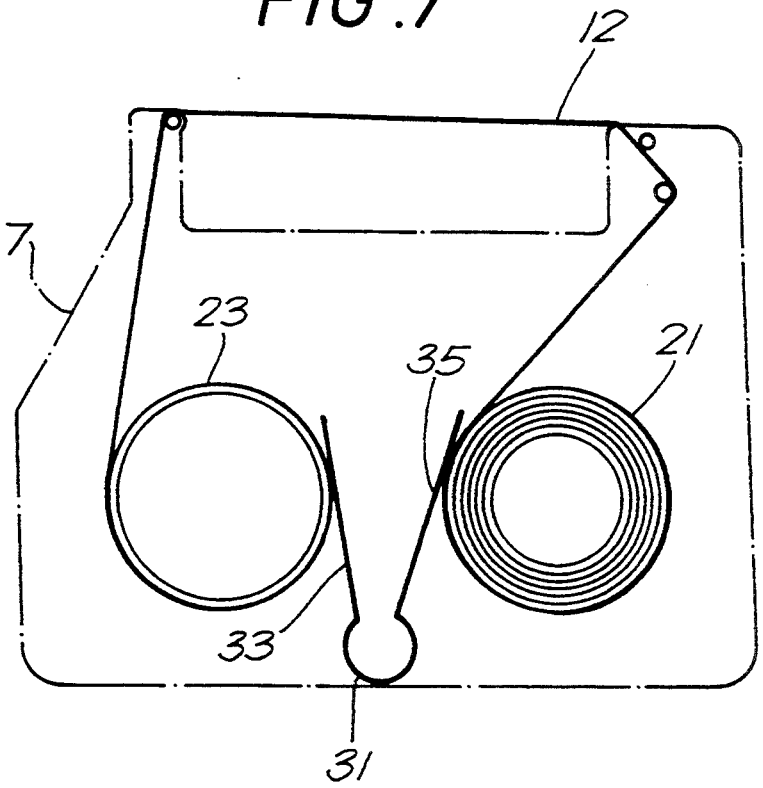
FIG. 7 is a diagrammatic view showing some internal components of the first cassette.

FIG. 7 is a diagrammatic view showing internal features of the ink ribbon cassette 7. In particular, the supply spool 21 and take-up spool 23 can be clearly seen, and the cassette includes a spring 31 which has arms 33,35 biased against the ink ribbon wound on the supply and take-up spools to keep the ribbon taut.

Figure 8:
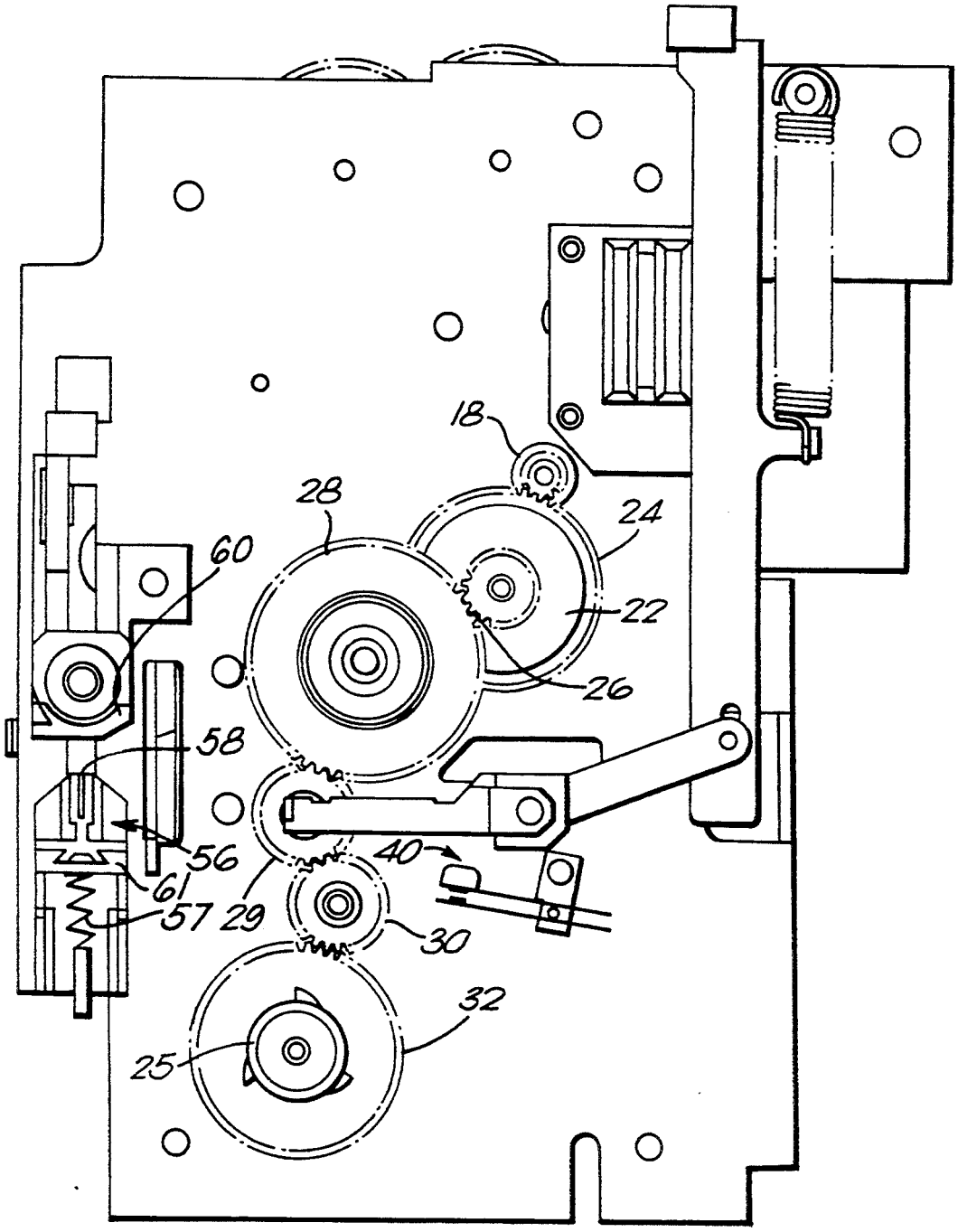
FIG. 8 is a diagrammatic plan view of the drive mechanism of the printing apparatus.

FIG. 8 is a plan view of the cassette receiving bay 13 of the printing device, with the floor of the bay having been removed to illustrate the drive mechanism. The drive mechanism includes a stepper motor 18 which drives the outer diameter of a double diameter gear 22 the inner diameter 26 of which drives an intermediate gear 28. The intermediate gear 28 drives a gear 29 which causes the platen 8 to rotate. The gear 29 drives a further gear 30 which in turn engages a gear 32 associated with the drive member 25. This drive mechanism causes the platen to rotate when the printing apparatus is being used for printing. The stepper motor 18 is also used to implement the cassette autowind feature of the present invention when the printhead 16 no longer bears against the platen 8. Thus, although the platen 8 will rotate it has no effect because it is not in contact with the printhead.

The printing apparatus includes a microswitch 40 which is responsive to the position of the lid and thus to the position of the printhead when an ink ribbon cassette 7 is inserted into the printing apparatus. The operation of this switch to detect the position of the lid when an ink ribbon cassette is located in the device is described in more detail in our copending U.S. application Ser. No. 08/180,210. In fact, the microswitch is actuated by a mechanical linkage coupling the lid to the print head. Other ways of detecting the movement of the printhead could be used in the present invention.

The printing apparatus has control circuitry which is responsive to signals from the microswitch 40 to control the stepper motor 18 to implement the cassette autowind feature in the condition that the machine is switched on, a cassette is present in the printing apparatus and the lid is moved from its closed to its opened position. This generally corresponds to the case where a user wishes to change one of the cassettes. In the case where the lid does not cause the printhead to move from its operative to its inoperative position, the movement of the printhead itself can be sensed.

Figure 6:
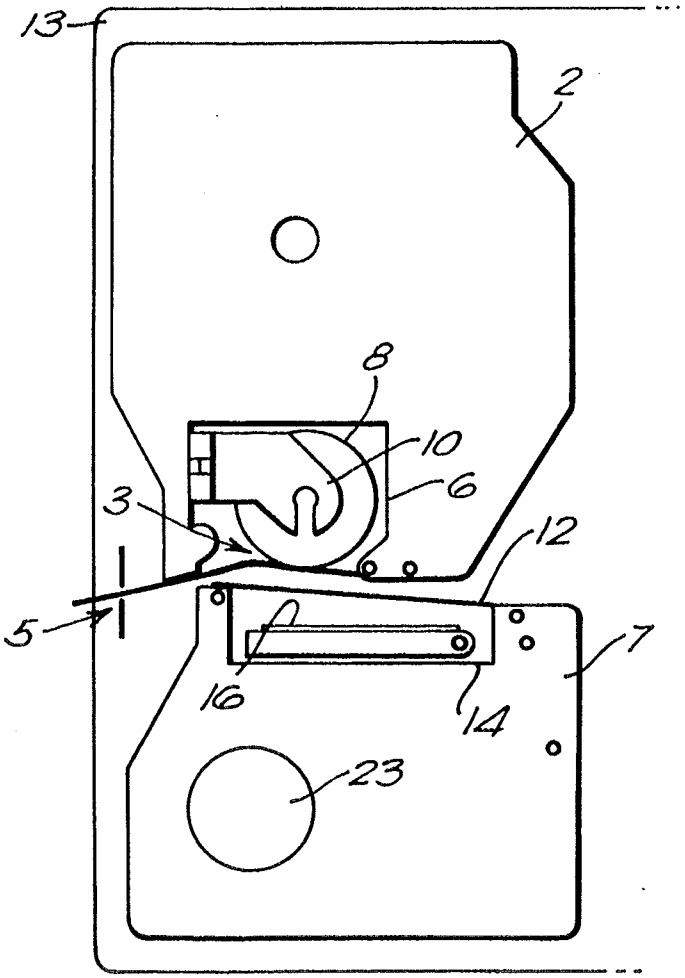

The winding on of a small portion of ink ribbon causes the ink ribbon to be tightened up as illustrated in FIG. 6. The spring 31 in the ink ribbon cassette 7 presses on the ribbon wound on both the supply and take-up reels 21,23 to keep the ribbon taut. This greatly simplifies removal and insertion of both the ink ribbon cassette and image receiving tape cassette.

What is claimed is:

1. A printing apparatus including: first and second cassette receiving portions for receiving respective first and second cassettes, the first cassette containing a supply of ink ribbon extending between a supply spool and a take-up spool and the second cassette containing an image receiving tape; a drive member for driving the take-up spool of the first cassette received in the first cassette receiving portion; and a printing mechanism comprising first and second cooperating printing elements arranged so that the image receiving tape and the ink ribbon extend in overlap between the printing elements when the cassettes are located in the cassette receiving portions, at least the first printing element being movable between an operative position and an inoperative position, the printing apparatus further comprising control circuitry responsive to movement of the first printing element from its operative position to its inoperative position for selective removal and insertion of the second cassette from the second cassette receiving portion with the first cassette in the first cassette receiving portion to cause the drive member to rotate, thereby rotating the take-up spool of the first cassette to tension the ink ribbon to facilitate the selective removal and insertion of the second cassette.

2. A printing apparatus according to claim 1, wherein the first printing element is a thermal printhead and the second printing element is a platen.

3. A printing apparatus according to claim 2, which comprises drive means connected to cause the drive member to rotate and connected to cause the platen to rotate.

4. A printing apparatus according to claim 1, which comprises a lid for covering the first and second cassette receiving portions, the first printing element being coupled to the lid so that when the lid is opened the first printing element is moved from its operative position to its inoperative position.

5. A printing apparatus according to claim 1, wherein the first printing element is coupled to an actuating member and wherein the printing apparatus further comprises a switch located to sense movement of the actuating member, said control circuitry being coupled to said switch and operable to cause the drive member to rotate.

6. A printing apparatus according to claim 1 wherein said first cassette further comprises biasing means having first and second portions respectively holding ink ribbon on the supply spool and the take-up spool to maintain the tension in the ink ribbon.

7. A printing apparatus having: first and second cassette receiving portions and, located in said first and second cassette receiving portions, respective first and second cassettes, the first cassette containing a supply of ink ribbon extending between a supply spool and a take-up spool and the second cassette containing an image receiving tape; the printing apparatus also having a drive member for driving the take-up spool of the first cassette; and a printing mechanism comprising first and second cooperating printing elements arranged so that the image receiving tape and the ink ribbon extend in overlap between the printing elements, at least the first printing element being movable between an operative position and an inoperative position, the printing apparatus further comprising control circuitry responsive to movement of the first printing element from its operative to its inoperative position for selective removal and insertion of the second cassette from the second cassette receiving portion with the first cassette in the first cassette receiving portion to cause the drive member to rotate, thereby rotating the take-up spool of the first cassette to tension the ink ribbon to facilitate the selective removal and insertion of the second cassette.

8. A printing apparatus according to claim 7, wherein the first printing element is a thermal printhead and the first cassette has a recess sized to receive the thermal printhead.

9. A printing apparatus according to claim 7 or 8, wherein the second printing element comprises a platen and the second cassette includes a recess for accommodating the platen.

10. A printing apparatus according to claim 7 wherein said first cassette further comprises biasing means having first and second portions respectively holding ink ribbon on the supply spool and the take-up spool to maintain the tension in the ink ribbon.

* * * * *